US009616260B1

(12) United States Patent
Chubb et al.

(10) Patent No.: US 9,616,260 B1
(45) Date of Patent: Apr. 11, 2017

(54) HORIZONTALLY DEPLOYABLE SMOKE/FIRE CURTAIN ASSEMBLY

(71) Applicant: Smoke Guard, Inc., Boise, ID (US)

(72) Inventors: Alexander Engsan Chubb, Sydney (AU); Brendan William Lawry, Sydney (AU); Christopher Gordon Dennis Todd, Beaconsfield (AU)

(73) Assignee: Smoke Guard, Inc., Boise, ID (US)

( * ) Notice: Subject to any disclaimer, the term of this patent is extended or adjusted under 35 U.S.C. 154(b) by 0 days.

(21) Appl. No.: 14/749,473

(22) Filed: Jun. 24, 2015

Related U.S. Application Data

(60) Provisional application No. 62/017,157, filed on Jun. 25, 2014.

(51) Int. Cl.

| | |
|---|---|
| ***A62C 2/18*** | (2006.01) |
| ***E06B 1/04*** | (2006.01) |
| ***A62C 2/24*** | (2006.01) |
| ***E06B 9/58*** | (2006.01) |
| ***E06B 9/70*** | (2006.01) |

(52) U.S. Cl.
CPC ..... *A62C 2/18* (2013.01); *A62C 2/247* (2013.01); *E06B 1/04* (2013.01); *E06B 9/58* (2013.01); *E06B 9/581* (2013.01); *E06B 9/70* (2013.01); *E06B 2009/587* (2013.01)

(58) Field of Classification Search
CPC .. A62C 2/18; A62C 2/16; A62C 2/247; E06B 1/04; E06B 9/56; E06B 9/58; E06B 9/70; E06B 9/581; E06B 9/587
See application file for complete search history.

(56) References Cited

U.S. PATENT DOCUMENTS

| | | | | | |
|---|---|---|---|---|---|
| 881,507 | A * | 3/1908 | Wallen | E06B 9/581 | 160/267.1 |
| 2,132,986 | A * | 10/1938 | Julien | E06B 9/581 | 160/265 |
| 4,955,092 | A * | 9/1990 | Hagan | E04H 4/101 | 242/390.8 |
| 5,868,191 | A * | 2/1999 | Blackmon, Jr. | A47H 21/00 | 160/237 |
| 6,035,918 | A * | 3/2000 | Kraeutler | E06B 9/13 | 160/267.1 |

(Continued)

*Primary Examiner* — Blair M Johnson
(74) *Attorney, Agent, or Firm* — Perkins Coie LLP

(57) ABSTRACT

A barrier assembly comprising a horizontally deployable vapor barrier assembly with a frame with opposing side guides extending between a header and footer. A guide rod contained in each side guide extends between the header and the footer. A vapor barrier is deployable horizontally with side edge sleeve portions that slide axially over the guide rods. At least one roller is connected to each of the side guides adjacent to the guide rod, and each roller supports a portion of the vapor barrier's side edge portions. The rollers rolls on the edge portions as the sleeve portion slides axially over the guide rods as the vapor barrier moves between the deployed and stowed positions. Lifter plates are attached to each of the side guides and positioned to engage support carriages and temporarily lift the support member out of engagement with the support surface over segment joints as the vapor barrier moves between the stowed and deployed positions. A drive system moves the vapor barrier between the stowed and deployed positions.

22 Claims, 10 Drawing Sheets

(56) References Cited

U.S. PATENT DOCUMENTS

| | | | | |
|---|---|---|---|---|
| 6,691,761 | B1 * | 2/2004 | Alkhoury | E06B 9/54 160/273.1 |
| 7,360,575 | B2 * | 4/2008 | Weiss | A47F 3/0469 160/264 |
| 8,622,112 | B2 * | 1/2014 | Tremaine, III | E06B 9/0692 160/264 |

* cited by examiner

HORIZONTALLY DEPLOYABLE SMOKE/FIRE CURTAIN ASSEMBLY

CROSS-REFERENCE TO RELATED APPLICATION

This non-provisional utility patent application hereby claims the benefit of and priority to U.S. Provisional Patent Application No. 62/017,157, titled HORIZONTALLY DEPLOYABLE SMOKE/FIRE CURTAIN ASSEMBLY, filed Jun. 25, 2014, which is incorporated herein by reference thereto.

TECHNICAL FIELD

Embodiments of the present invention are directed to smoke and/or fire barrier systems, and more particularly to horizontally deployable smoke and/or fire barrier assemblies and related methods.

BACKGROUND

Smoke, fumes, and noxious gasses can be very dangerous to occupants during a building fire. It is well known that many fire-related deaths are the result of smoke inhalation. During a fire, or an event where smoke or other undesirable gases may be present, fumes are likely to travel very quickly through paths that offer little resistance. Paths such as elevator shafts, stairwells, atriums, or other open passageways between multiple floors of a building are often well drafted and provide an excellent avenue by which smoke and other undesirable gases can travel rapidly to otherwise unaffected areas of a building. To prevent such a migration of undesirable gases, many devices and assemblies have been designed to limit the vapor and/or fire dispersal by cutting off possible paths or openings.

Examples of such devices are smoke screen assemblies disclosed in U.S. Pat. No. 5,383,510, entitled APPARATUS AND METHOD FOR RAPIDLY AND RELIABLY SEALING OFF CERTAIN OPENINGS IN RESPONSE TO SMOKE, NOXIOUS FUMES OR CONTAMINATED AIR, issued Jan. 24, 1995; U.S. Pat. No. 5,195,594, entitled APPARATUS AND METHOD FOR RAPIDLY AND RELIABLY SEALING OFF CERTAIN EXIT AND ENTRANCE WAYS IN RESPONSE TO SMOKE OR FIRE, issued Mar. 23, 1993; U.S. Pat. No. 7,000,668, entitled SYSTEM AND METHOD FOR SEALING OPENINGS IN RESPONSE TO SMOKE, NOXIOUS FUMES, OR CONTAMINATED AIR USING A ROLL-DOWN BARRIER, issued Feb. 21, 2006; U.S. Pat. No. 7,028,742, entitled SYSTEM AND METHOD FOR SEALING OPENINGS IN RESPONSE TO SMOKE, NOXIOUS FUMES, OR CONTAMINATED AIR USING A ROLL-DOWN BARRIER, issued Apr. 18, 2006; U.S. Patent Application No. 2006/0226103, entitled CLOSING MEMBER CONTROL SYSTEMS, INCLUDING DOOR CONTROL SYSTEMS FOR BARRIER HOUSINGS, AND ASSOCIATED METHODS, filed Oct. 12, 2006; and U.S. Provisional Patent Application No. 61/164,876, entitled BARRIER SYSTEMS AND ASSOCIATED METHODS, INCLUDING VAPOR AND/OR BARRIER SYSTEMS WITH MANUAL EGRESS, filed Mar. 30, 2009, U.S. Pat. No. 8,113,266, entitled BARRIER SYSTEMS AND ASSOCIATED METHODS, INCLUDING VAPOR AND/OR FIRE BARRIER SYSTEMS, issued Feb. 14, 2012, U.S. Patent Publication No. 2010/0243175, entitled BARRIER SYSTEMS AND ASSOCIATED METHODS, INCLUDING VAPOR AND/OR FIRE BARRIER SYSTEMS WITH MANUAL EGRESS, filed Mar. 30, 2010, and U.S. Patent Publication No. 2011/0088918, entitled FIRE-RATED MULTIFABRIC WITH INTUMESCENT LAYER, filed Oct. 19, 2010; each of which is incorporated herein by reference in its entirety.

SUMMARY

Aspects of the present disclosure are directed to a horizontally deployable smoke and/or fire barrier assembly that overcomes drawbacks experienced in the prior art and that provides other benefits. At least one of the embodiments of the present technology provides a barrier assembly comprising a horizontally deployable vapor barrier assembly comprising a frame mountable to the structure around the passageway. The frame has a header, a footer substantially opposite the header, and opposing side guides extending between the header and footer. The side guides have a plurality of interconnected side guide segments extending between the header and footer, and adjacent side guide segments have substantially coplanar support surfaces that define a joint therebetween. A guide rod is contained in each side guide, and the guide rod extends substantially between the header and the footer. A vapor barrier is coupled to the frame and moveable relative to the passageway between a stowed position wherein the vapor barrier substantially does not obstruct the passageway and a deployed position wherein the barrier extends substantially horizontally across the passageway to block passage of fire or vapor through the passageway. The vapor barrier has opposing side edge portions extending between leading and trailing edge portions. Each side edge portion has a sleeve portion surrounding a respective guide rod and is captured in the respective side guide. The sleeve portion is configured to slide axially over the guide rod as the vapor barrier moves between the deployed and stowed positions.

A substantially rigid leading edge member is connected to the leading edge portion of the vapor barrier and has lateral end portions adjacent to the side guides. The leading edge member is positioned at least adjacent to the header when the vapor barrier is in the stowed position, and the leading edge member is positioned at least adjacent to the footer when the vapor barrier is in the deployed position. Support carriages are coupled to the leading edge member. Each support carriage is positioned adjacent to a respective lateral end portion and has a support member positioned to engage and move along the support surfaces of the interconnected segments of the side guide as the vapor barrier moves between the stowed and deployed positions. At least one roller is connected to each of the side guides and is positioned adjacent to the guide rod. Each roller supports a portion of a respective one of the side edge portions of the vapor barrier, wherein the roller rolls on the edge portion of the vapor barrier as the sleeve portion slides axially over the guide rod as the vapor barrier moves between the deployed and stowed positions. In one embodiment, a plurality of lifter plates are attached to each of the side guides in alignment with the joint seam between interconnected segments of the side guides. The lifter plates are positioned to engage the support carriages and temporarily lift the support member out of engagement with the support surface over the joints as the barrier moves between the stowed and deployed positions. A drive system is coupled to the barrier and is activatable to move the vapor barrier between the stowed and deployed positions.

Another embodiment in accordance with an aspect of the present disclosure provides a vapor barrier assembly for use to removably block a passageway from passage of fire and/or vapors therethrough. The assembly comprises a frame having a header, a footer, and opposing side guides extending between the header and footer. Each side guide has an interior area and has a support surface with a surface discontinuity. A guide member is contained in the interior area of each side guide and extends substantially between the header and the footer. A barrier is coupled to the frame and moveable between stowed and deployed positions. In the stowed position, the full barrier is substantially in or adjacent to the header, and in the deployed position the barrier extends substantially fully between the header and footer and between the side guides. The barrier has opposing leading and trailing edge portions and opposing side edge portions extending between the leading and trailing edge portions. At least a portion of each side edge portion is captured within the interior area of a respective side guide and slidably engages a respective guide rod. The side edge portion is configured to slide axially over the guide rod as the barrier moves between the deployed and stowed positions. A leading edge member is connected to and movable with the leading edge portion of the barrier relative to the frame. The leading edge member extends between the side guide and has an end portion adjacent to at least one of the side guides.

A support carriage is movable with the leading edge member as a unit relative to the side guides. The support carriage is positioned adjacent to a respective end portion and has a support member positioned to move along the support surface of the respective side guide as the barrier moves between the stowed and deployed positions. A lifter plate is attached to the side guides adjacent to the surface discontinuity. The lifter plate has an engagement surface located in a plane substantially normal to the support surface and positioned to engage the support carriage and temporarily lift the support member out of engagement with the support surface over the surface discontinuity as the barrier moves between the stowed and deployed positions.

DETAILED DESCRIPTION

Various embodiments of the disclosure will now be described. The following description provides specific details for a thorough understanding and enabling description of these embodiments. One skilled in the art will understand, however, that the disclosure may be practiced without many of these details. Additionally, some well-known structures or functions may not be shown or described in detail, so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the disclosure. Certain terms may even be emphasized below; however, any terminology intended to be interpreted in any restricted manner will be overtly and specifically defined as such in this Detailed Description section. As used herein vapor includes gases or gases carrying particulates (e.g., solid and/or liquid particulates), such as smoke, fumes, smoke with soot particles, contaminated air, noxious fumes, and/or the like.

References throughout the specification to "one embodiment" or "an embodiment" means that a particular feature, structure, or characteristic described in connection with the embodiment and included in at least one embodiment of the present disclosure. Thus, the appearances of the phrase "in one embodiment" or "in an embodiment" in various places throughout the specification are not necessarily all referring to the same embodiment. Furthermore, the particular features, structures, or characteristics may be combined in any suitable manner in one or more embodiments.

Figure 1:
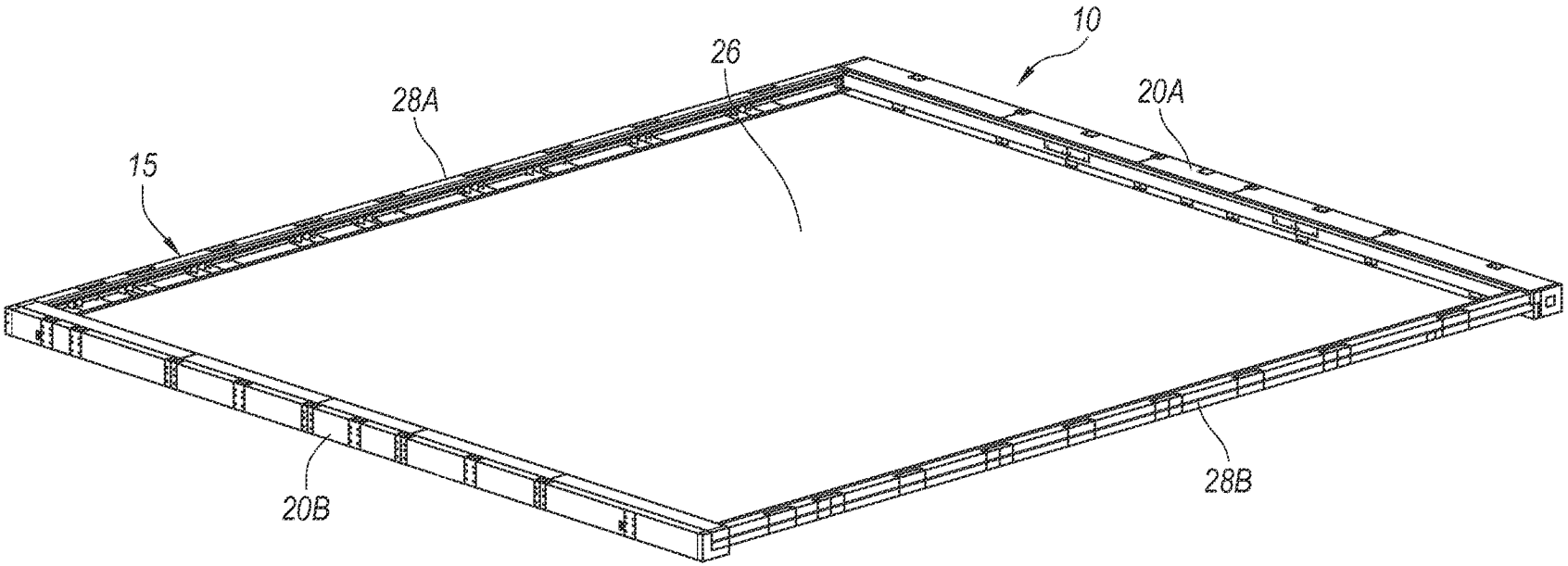
FIG. 1 is an isometric view of a barrier assembly in accordance with an embodiment of the present disclosure, wherein a fire and/or vapor barrier is in a stowed position.
Figure 2:
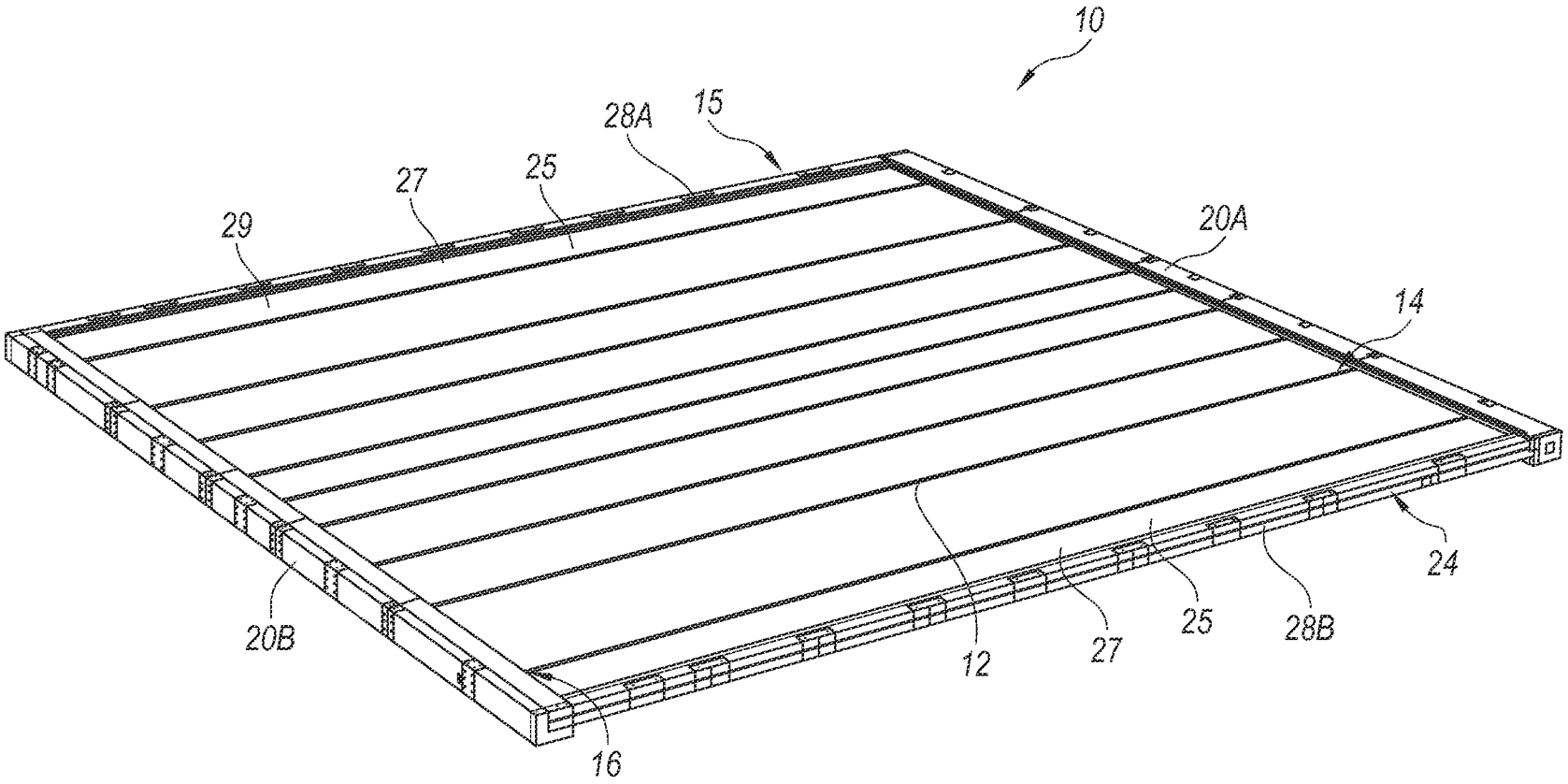
FIG. 2 is an isometric view of the barrier assembly of FIG. 1 with the fire/vapor barrier shown in a deployed position.

FIGS. 1-6 illustrate various features of a barrier assembly 10 in accordance with embodiments of the present technology. FIG. 1 is an isometric view of a barrier assembly 10 with a vapor barrier 12 in a retracted, stowed position in a first housing, referred to herein as a head box 20A. FIG. 2 is an isometric view of the assembly 10 with the vapor barrier 12 shown in an extended, deployed position. The assembly 10 is a horizontally deployable, smoke and/or fire barrier assembly mountable to a structure 22, such as a wall, ceiling, or other structure of a building or the like. The assembly 10 is configured to be mounted around a vertically-oriented passageway 26 in the building, such as an atrium, a court, or other open interior areas within a building. When the barrier 12 is moved to the deployed position, the barrier 12 extends substantially horizontally across and partitions a portion of the passageway 26 from the rest of the passageway. Accordingly, when the assembly 10 is deployed, such as in the event of a fire or other emergency condition, it will block smoke, vapors, and/or fire from moving vertically through the passageway 26.

In selected embodiments the barrier 12 and assembly 10 are configured to meet various industry standards to qualify as a smoke partition, a fire partition, a fire barrier, a smoke barrier, and/or a fire wall (e.g., in accordance with standards associated with the International Building Code, International Code Congress, NPFA Life Safety Code, etc.). For instance, in one embodiment the barrier 12 can include a flexible material that includes fiberglass that has been impregnated and/or coated with a flouropolymer such as a polytetraflouroethylene (PTFE) (e.g., such as Teflon®). In selected embodiments, a PTFE-coated material suitable for use as a smoke barrier can include CHEMFAB® (e.g., with a thickness of 0.003 to 0.004 inches), available from Saint-Gobain Performance Plastics Corporation of Elk Grove Village, Ill. In other embodiments, the barrier 12 can have other configurations, including being made from other materials and/or having other thicknesses.

The assembly 10 of the illustrated embodiment has a substantially horizontally-oriented frame 15 securely connected to the building's structure 22 around the passageway 26. The frame 15 includes the head box 20A substantially opposite a horizontally-oriented second housing, referred to herein as a foot box 20B. A pair of opposing side guides 28A and 28B extend between the head and foot boxes 20A, 20B. The head box 20A contains an accumulator shaft 44A attached to a trailing end 14 of the vapor barrier 12. The vapor barrier 12 is positioned to be wound onto and off of the shaft 44A as the barrier 12 is moved between the deployed and stowed positions by a drive system 42. The leading end 16 of the barrier 12 opposite the trailing end 14 is securely attached to a rigid leading edge member 18 that is received and retained at the foot box 20B when the barrier 12 is in the fully deployed position. The leading edge member 18 is configured to span substantially fully between the side guides 28A, 28B with a minimal amount of sag as the leading edge member moves between the stowed and deployed positions.

Figure 3:
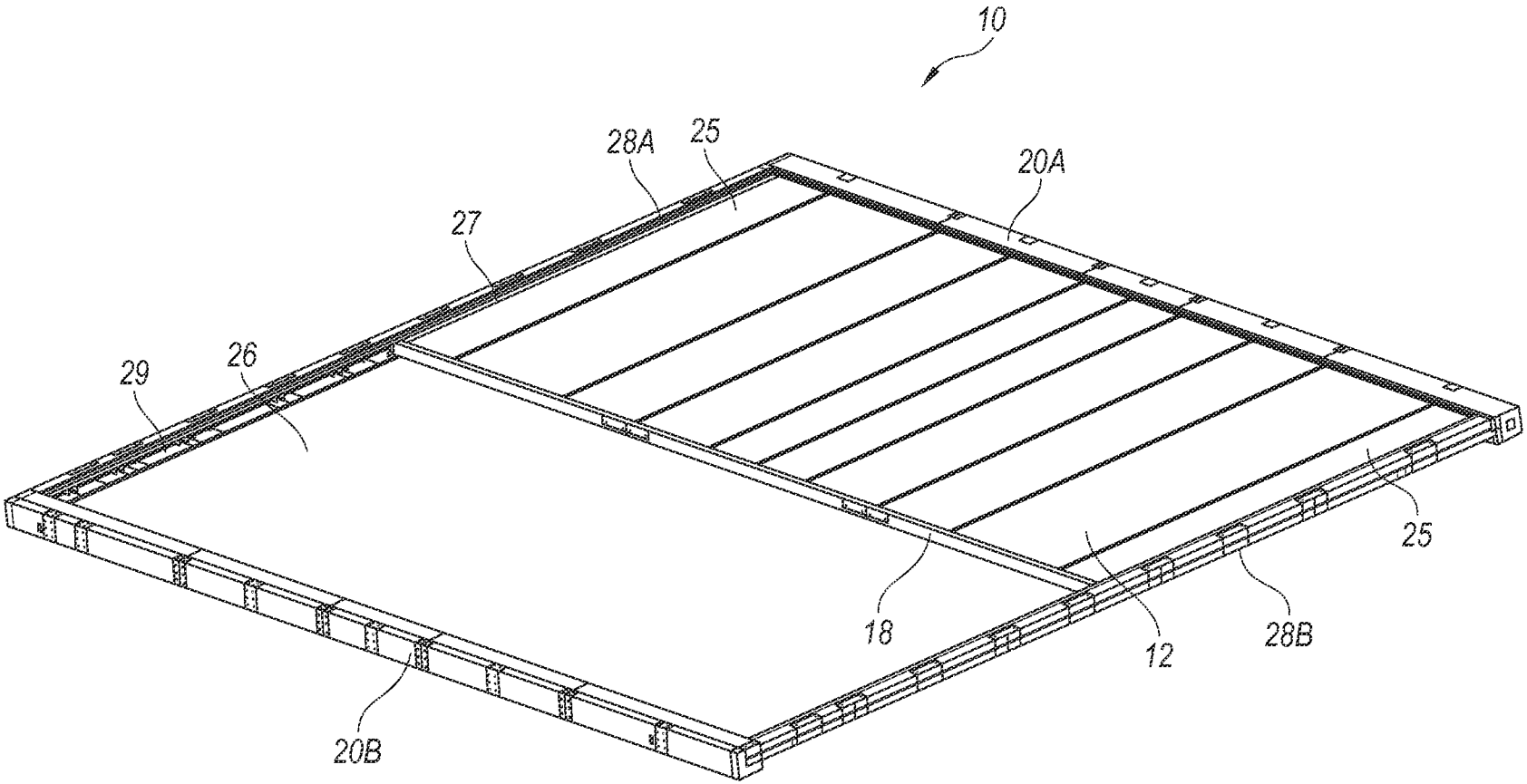
FIG. 3 is an isometric view of the barrier assembly of FIG. 1 with the fire/vapor barrier shown in an intermediate position between the stowed and deployed positions.

When the barrier 12 is in the fully stowed position, the leading edge member 18 is positioned in or immediately adjacent to the head box 20A, and the barrier 12 is substantially wound about the shaft 44A that extends generally parallel to a longitudinal axis of the head box 20A. Accordingly, the leading edge member 18 forms a closure to the head box 20A with the barrier 12 contained therein. Referring now to FIGS. 2 and 3, as the barrier 12 moves to the fully deployed position, the barrier 12 unwinds from the shaft 44A and the leading edge member 18 moves away from the head box 20A, the barrier's trailing end 14 remains in the head box 20A and the barrier's opposing side edge portions 25 slide along the opposing side guides 28A, 28B. When the barrier 12 is in the deployed position, the leading edge member 18 is removably retained within the foot box 20B. Accordingly, the barrier 12 extends substantially horizontally across the vertical passageway 26 bordered by the head and foot boxes 20A, 20B and the side guides 28A, 28B, thereby blocking fire, smoke, or other vapors from passing through the passageway 26.

Figure 4A:
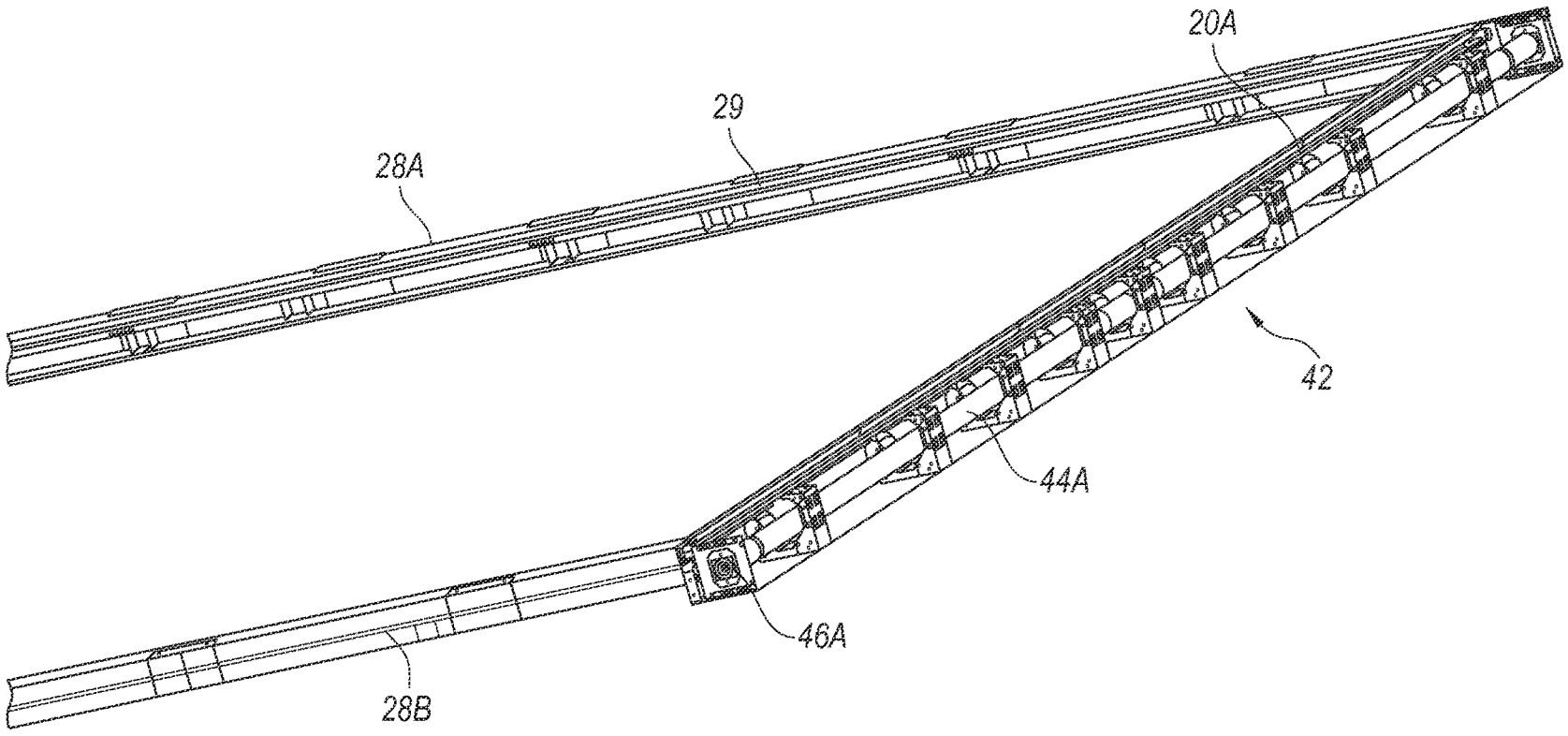
FIG. 4A is a partial enlarged rear view of a segment of the head box of the barrier assembly of FIG. 1 with the barrier and other portions of the assembly not shown to illustrate a portion of a drive system.
Figure 4B:
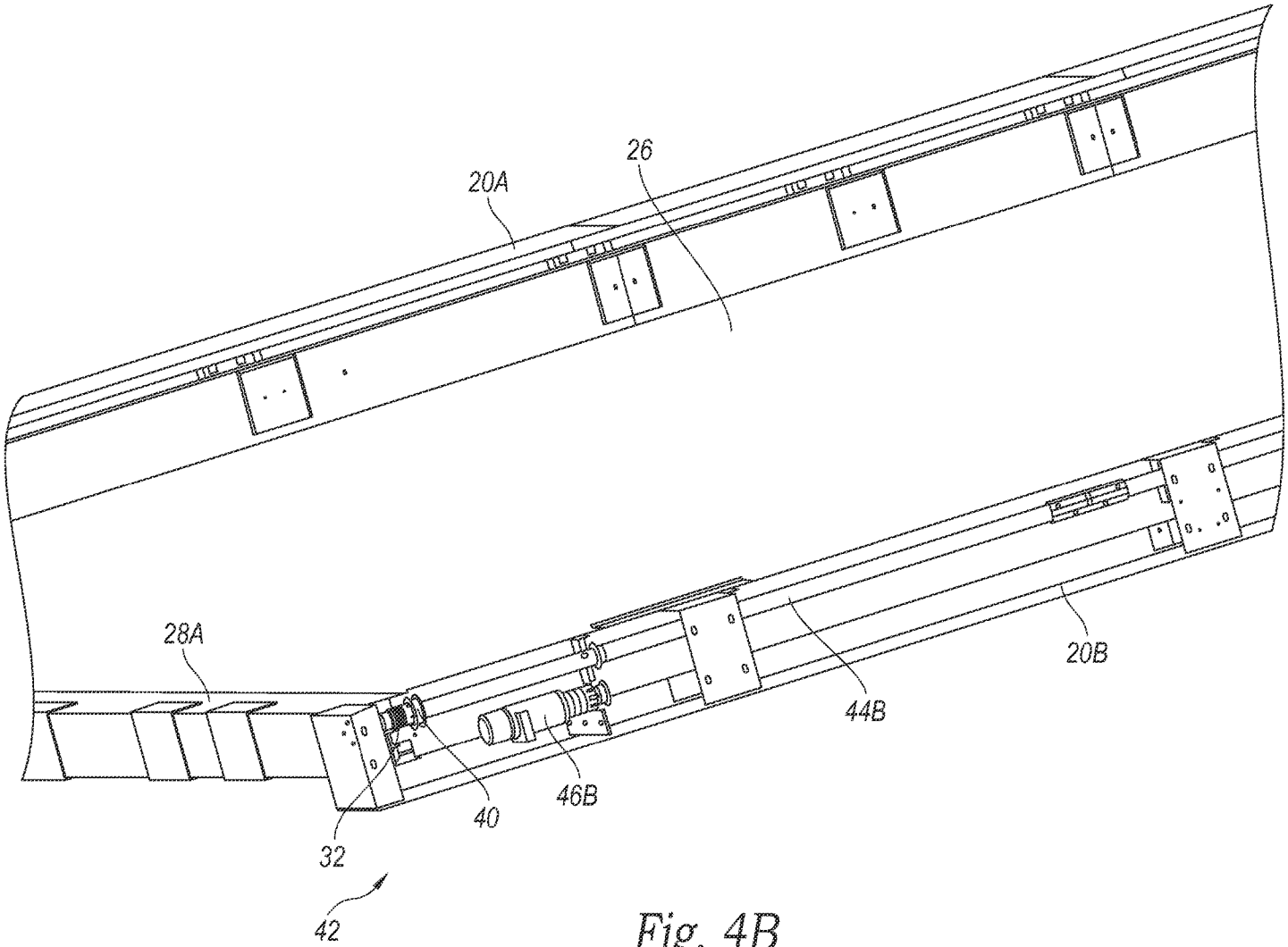
FIG. 4B is a partial enlarged rear view of a segment of the foot box of the barrier assembly of FIG. 1 with the barrier and other portions of the assembly not shown to illustrate another portion of the drive system.

As shown in FIGS. 4A-4B, the drive system 42 of the illustrated embodiment includes one or more drive motors (e.g., 46A and 46B) configured to move the barrier 12 between the deployed and stowed positions. The barrier 12 is not shown in FIGS. 4A and 4B for purposes of clarity and to avoid obscuring of features of the drive system 42 from view. In certain embodiments, a first drive motor 46A is a retraction motor operatively connected to the shaft 44A contained within the head box 20. The first drive motor 46A actively rotates the shaft 44A in a first rotational direction to wind the barrier 12 onto the shaft 44A and to retract the barrier 12 toward the stowed position. The drive motor 46A is also configured to actively and/or passively allow the shaft 44A to rotate in a second rotational direction opposite the first direction, thereby allowing the barrier 12 to unwind from the shaft 44A and move to the deployed position with the leading edge member 18 moving to the foot box 20B.

In the embodiment illustrated in FIG. 4B, the drive system 42 also has a deployment motor 46B coupled to the foot box 20B and configured to actively draw the leading edge member 18 away from the head box 20A, thereby drawing the barrier 12 toward the deployed position. The deployment motor 46B is operatively connected to a drive shaft 44B contained within the foot box 20B, such that activation of the deployment motor 46B will cause the drive shaft to rotate about its longitudinal axis. The drive shaft 44B is connected to one or more spools 40, which are in turn securely connected to first ends of horizontally-oriented deployment cables 36. The opposite second ends of the cables 36 are fixedly coupled to the leading edge member 18 on the leading edge 16 of the barrier 12. The deployment drive motor 46B is configured to rotate the drive shaft 44B and the associated spools 40 in one rotational direction, such that the cables 36 will wind onto the spools 40, thereby pulling horizontally on the leading edge member 18 toward the foot box 20B and drawing the barrier 12 toward the deployed position and across the passageway 26. As the deployment motor 46B rotates the drive shaft 44B in the foot box 20B and winds the cables 36 onto the spools, the drive shaft 44A in the head box is simultaneously rotating to allow the barrier 12 to unwind from the shaft 44A. The drive motor 46B can also be configured to actively and/or passively allow the drive shaft 44B and the spools 40 to rotate the opposite direction as the first drive motor 46A is rotating its drive shaft 44A to wind the barrier 12 onto the shaft 44A, thereby moving the barrier 12 and the leading edge member 18 toward the fully stowed position.

The drive system 42 can be operatively connected to a control system configured to command movement or operation of the drive system 42, which in turn can control movement of the barrier 12. The control system can also be operably coupled to at least one external device associated with the assembly 10, such as a fire alarm/detector, a smoke alarm/detector, or an external monitoring system that monitors and displays the status of the assembly 10 (or provides remote control of the assembly 10).

In the embodiment illustrated in FIG. 4B, the drive system 42 includes coil springs 32 or other biasing members coupled to the shafts 44A, 44B and/or the spools 40, and configured to decrease or eliminate rotational slip during deployment or retraction of the barrier 12. This configuration helps keep the cables 36 and the barrier 12 in tension and substantially taut across the frame 15 to prevent or decrease excessive sagging of the barrier 12 as the barrier 12 moves to and from the fully deployed position. In some embodiments, the drive motors 46A and 46B are also configured to keep the cables 36 and barrier 12 in tension during operation. In the illustrated embodiment, when the deployment motor 46B is activated to wind the cables 36 onto the spools 40 and draw the barrier toward the deployed position, the drive motor 46A in the head box 20A is configured to selectively resist the resulting rotation of the shaft 44A as the barrier unwinds. Similarly, when the drive motor 46A in the head box 20A is activated to wind the barrier 12 onto the shaft and move the barrier 12 to the stowed position, the deployment motor 46B is configured to selectively resist the resulting rotation of the shaft 44B in the foot box 20B as the barrier 12 winds and moves to the stowed position. Accordingly, the motors 46A and 46B act as braking mechanisms to create selected resistance to movement of the barrier 12 and help maintain the barrier 12 and cables 36 in tension. In the illustrated embodiment, the motors 46A and 46B are configured to use electromotive force (emf) to resist rotation of the motor's respective shaft 44A, 44B and to maintain the barrier 12 in tension during movement of the barrier 12 away from the stowed position.

As seen in FIGS. 1-3, the side guides 28A, 28B, the head box 20A, and foot box 20B comprises plurality of interconnected segments 24 arranged in a selected size and shape corresponding to the outline or "footprint" around the passageway 26 to be sealed off upon deployment of the assembly 10. A variety of shapes or "footprints" can be accommodated by interconnecting the plurality of the segments 24 in the desired arrangement to correspond to the shape of the selected passageway 26. Accordingly, the assembly 10 is a substantially modular system that can be constructed to match the needs of various passageway shapes and sizes for installation in a variety of buildings or other selected structures. Additionally, such a modular system allows a user to service and/or access different portions of the assembly 10 as necessary. According to certain embodiments, as illustrated in FIGS. 1-3, the plurality of interconnected segments 24 form the opposing two side guides 28A, 28B extending generally parallel to each other between the head box 20A and foot box 20B at substantially 90 degree angles relative to both the head box 20A and the foot box 20B to form a generally rectangular configuration.

As indicated above, the assembly 10 of the illustrated embodiment has the spaced apart side guides 28A, 28B that extend between the head and foot boxes 20A, 20B and fixedly mount to the building structure 22 adjacent to the vertically-oriented passageway 26. The side guides 28A, 28B each have vertically-oriented end walls 29 that can be bolted or otherwise fixed to the building structure 22 with substantially no air gap between the end wall 29 and the associated building structure. The side guides 28A, 28B are configured to carry, retain and guide the opposing side edge portions 25 of the barrier 12 within the side guides 28A, 28B while the barrier 12 moves to and from the deployed position. When the barrier 12 is in the fully deployed position, the side guides 28A, 28B securely retain the barrier's side edge portions 25 therein to keep the barrier 12 in tension laterally and to block fire, smoke, or other vapors from passing around the sides of the barrier 12.

Although further discussion of the side guides 28A, 28B may be discussed relative to only side guide 28A, side guide 28B can be configured with or include any and all features, in whole or in part, as discussed herein with respect to side guide 28A.

Each side guide 28A and 28B slidably captures and retains the respective side edge portion 25 of the barrier 12 while allowing the barrier 12 to move between the stowed and deployed positions. Each side edge portion 25 has an elongate sleeve portion 27 extending substantially between the barrier's leading and trailing ends 16 and 14. The sleeve portion 27 can be formed by folding and securing the side edge of the barrier 12 onto itself so as to form a hollow tubular portion along the length of the barrier's side edge portion 25. Each side edge portion 25, including the sleeve portion 27, extends through a narrow elongate slot 29 in the side guide 28A, 28B and slidably connects to a guide rod 30 within the side guide 28A, 28B (FIGS. 5A-5D). In the illustrated embodiment, the guide rod 30 extends generally parallel to a longitudinal axis of the side guide 28A, 28B between the head box 20A and the foot box 20B.

At least a portion of the guide rod 30 is positioned within the barrier's sleeve portion 27 at all times, such that the guide rod 30 is generally concentrically disposed within the sleeve portion 27. Each guide rod 30 has a diameter greater than the opening of the slot 29, such that the guide rod 30 captures the barrier's side edge portion 25 and block's the side edge portion 25 from being pulled laterally out of the side guides 28A, 28B. When the barrier 12 is in the fully stowed position, most of the barrier 12 is wound about the shaft 44A, but the side edge portions 25 of the barrier adjacent to the leading edge member 18 are still disposed in the side guides 28A, 28B and positioned over the free end portions of guide rods 30. When the barrier 12 is in the fully deployed position, almost the full length of the guide rods 30 are positioned within the barrier's side sleeve portions 27. As the barrier 12 is deployed from the stowed position toward the deployed position, the barrier 12 unwinds from the shaft 44A as the leading edge member 18 is pulled away from the head box 20A, and the barrier's side edge portions 25 spaced apart from the shaft 44A are pulled axially over the guide rods 30 and along the narrow slots 29 of the side guides 28A, 28B. As indicated above, the barrier 12 is maintained in tension as it moves between the stowed and deployed positions, and this tensioned configuration helps keep the side edge portions 25 aligned with the guide rods 30, so the barrier 12 smoothly slides over the guide rods 30 during the movement to and from the deployed position.

In the illustrated embodiment, the leading edge of each sleeve portion 27 is securely attached to a rigid bushing 50, and each bushing 50 is slidably positioned around a respective guide rod 30. Each bushing 50 of the illustrated embodiment is a metal bushing with an inner diameter greater than the guide rod's outer diameter, such that the bushing keeps the leading edge of the sleeve portion 27 open and free to slide over the guide rod 30.

Figure 5A:
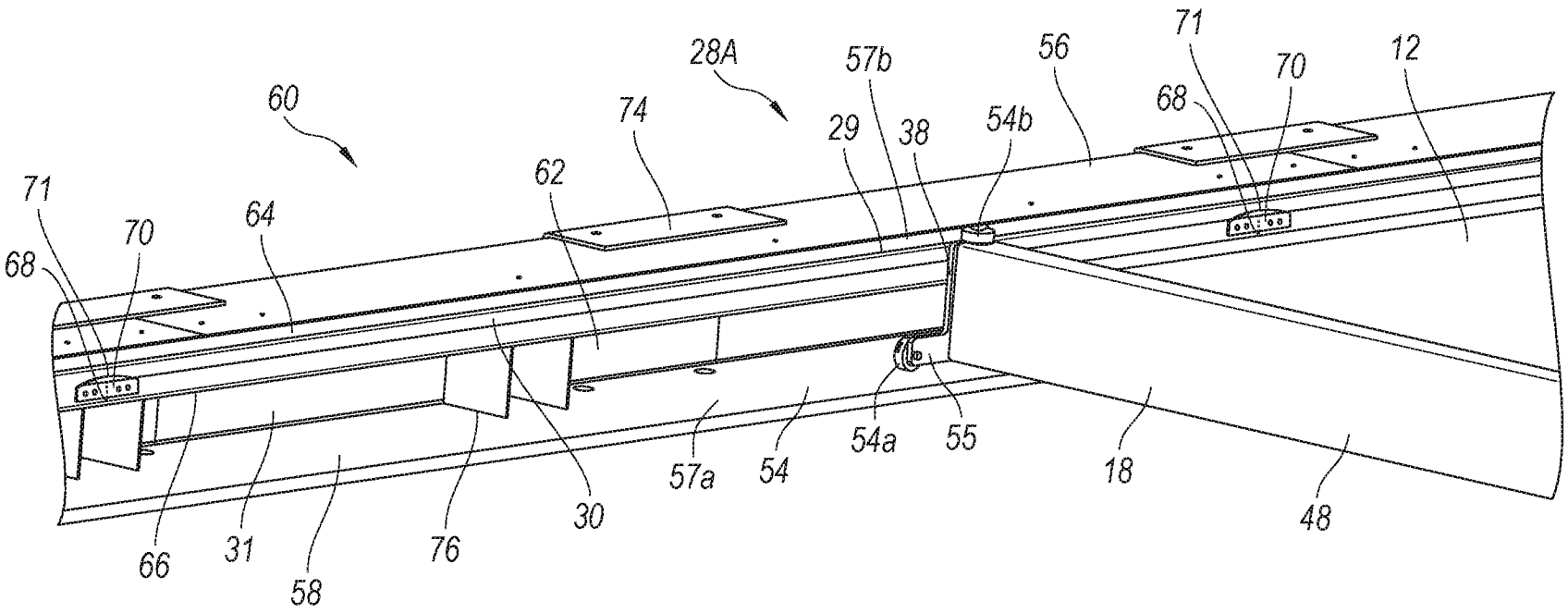
FIG. 5A is a partial view of a segment of the barrier assembly of FIG. 1 with the barrier and other portions of the assembly not shown to illustrate certain features.
Figure 5B:
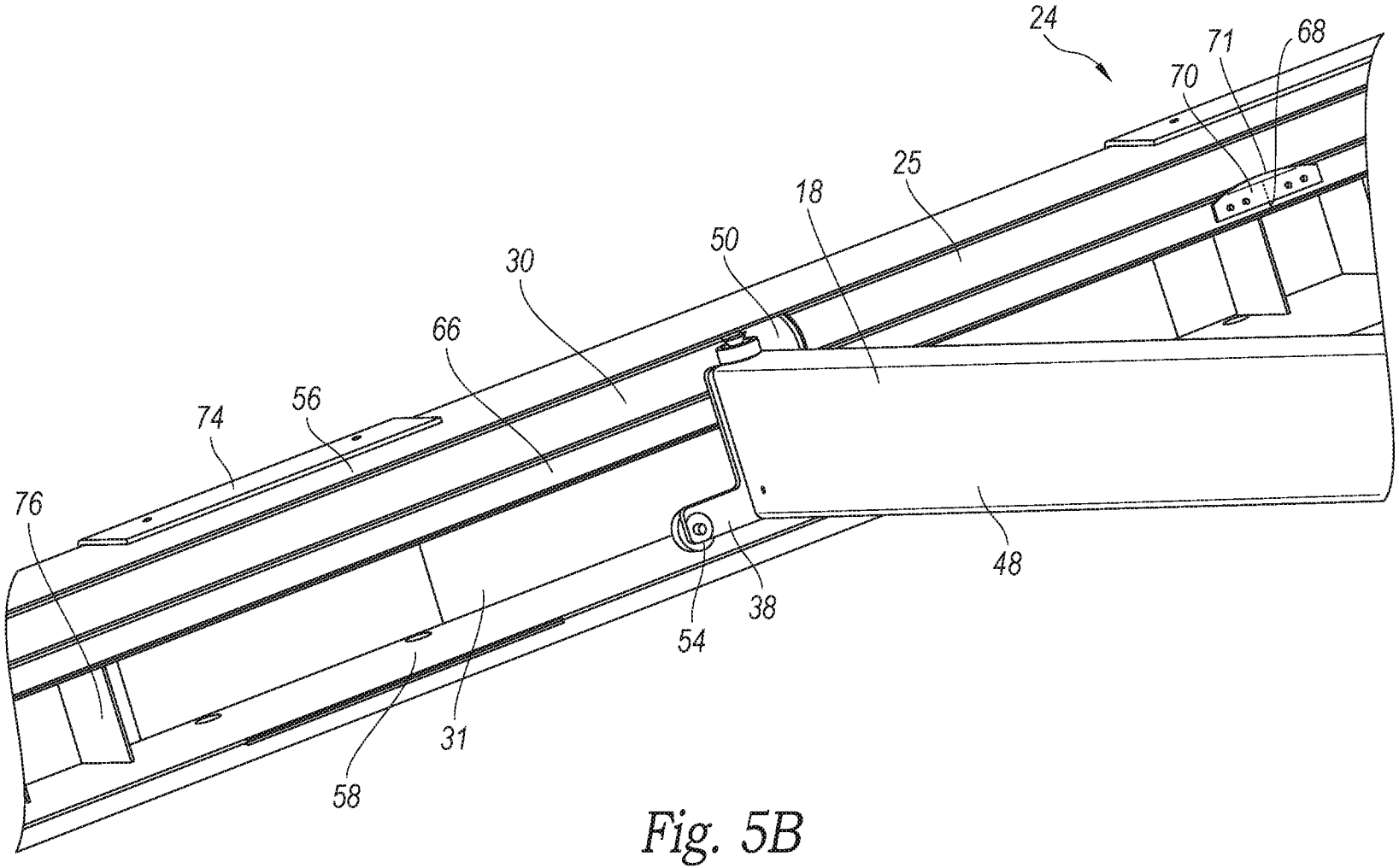
FIG. 5B is a partial view of a segment of the barrier assembly of FIG. 1 with the barrier and other portions of the assembly not shown to illustrate certain features.
Figure 5C:
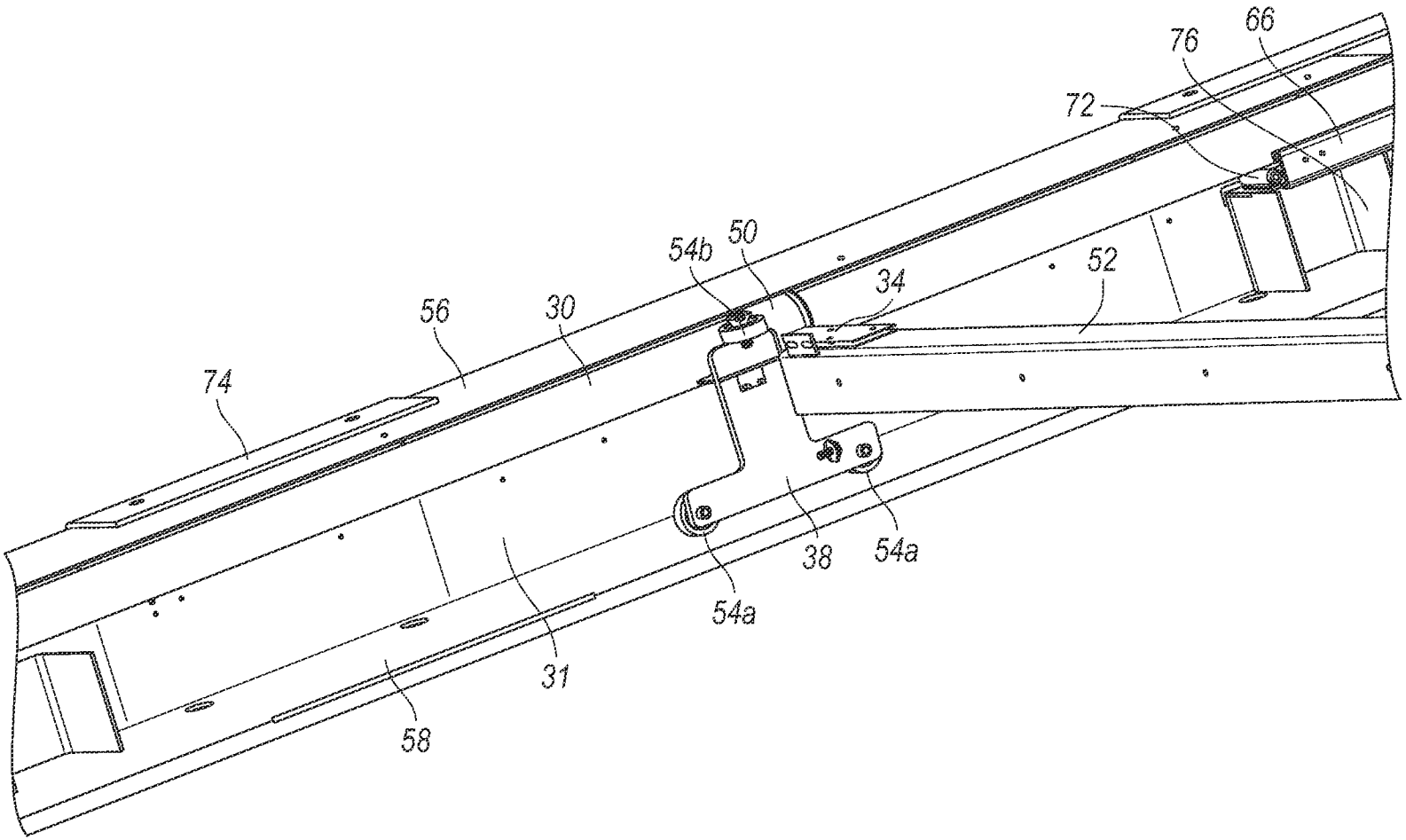
FIG. 5C is a partial view of a segment of the barrier assembly of FIG. 1 with the barrier and other portions of the assembly not shown to illustrate certain features.
Figure 5D:
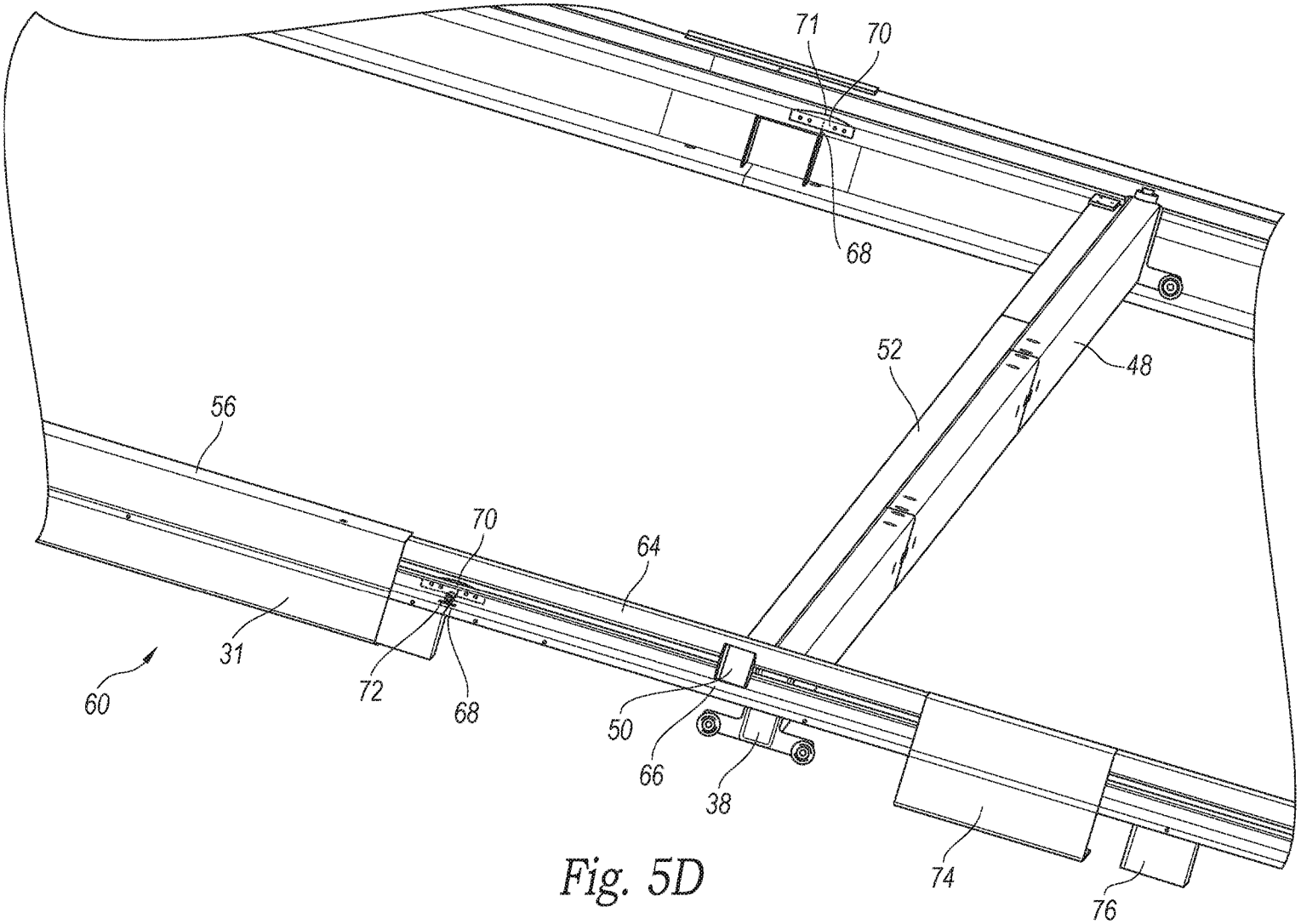
FIG. 5D is a partial view of a segment of the barrier assembly of FIG. 1 with the barrier and other portions of the assembly not shown to illustrate certain features.

The bushings 50 are also securely connected to the ends of the leading edge member 18, such that the leading edge member 18, the bushing 50, and the leading end 14 of the barrier 12 all move as a unit relative to the side guides 28A, 28B. As shown in FIG. 5C, the leading end of each sleeve portion 27 surrounds the bushing 50 and is fixed to the bushing 50 by a retention strap 34 that also wraps around the bushing 50 so the sleeve portion 27 is captured between the bushing 50 and the retention strap 34. Each retention strap 34 is securely connected to the lateral end of the leading edge member 18 by a rigid mounting plate 52, thereby rigidly retaining the bushing 50 and the end of the sleeve portion 27 in a substantially fixed relationship while being moveable as a unit relative to the side guides 28A, 28B. As the barrier 12 moves between the stowed and deployed positions, the bushings 50 move axially over the guide rods 30, thereby sliding the barrier's sleeve portions 27 over the guide rods 30 while remaining laterally captured and supported within the side guides 28A, 28B.

The side guides 28A, 28B also support the lateral ends of the leading edge member 18 and the associated leading end 14 of the barrier 12 in the vertical direction. As shown in FIGS. 5A-5C, each the lateral end of the leading edge member 18 is connected to a wheeled carriage 38 having one or more wheels 54 attached to an inverted T-shaped body 55. The carriage 38 of the illustrated embodiment has a pair of vertically-oriented lower wheels 54*a* and a horizontally-oriented upper wheel 54*b* configured to roll along support surfaces 57*a* and 57*b* of the side guide 28A, 28B. The lower support surface 57*a* is defined by a horizontally-oriented bottom wall portion 58 of the side guide 28A substantially parallel to and spaced below the guide rod 30. The upper support surface 57*b* is defined by a vertically-oriented wall portion 66 (FIG. 5A) positioned laterally inward of the guide rod 30. The vertically-oriented wall portion 66 of the illustrated embodiment defines a portion of the slot 29 through which the barrier's side edge portion 25 extends, as discussed above. As the barrier 12 moves between the stowed and deployed positions, the carriages 38 help maintain the positioning and alignment of the leading edge member 18 and the bushings 50 relative to the guide rods 30.

As discussed above, the side guides 28A, 28B are substantially modular members comprising a plurality of interconnected segments 24. The segments 24 of the illustrated side guides 28A, 258B include C-shaped body segments 60 having horizontally-oriented upper and lower wall portions 56, 58 extending from the vertically-oriented end wall 31. The body segments 60 in other embodiments can have other configurations, such as segments with U-shaped, I-shaped, L-shaped, or T-shaped cross-sections. Further, the side guides 28A, 28B can include intermediate support members 64 connected to the end wall 31 and positioned between the upper and lower wall portions 56, 58. A flange portion of the intermediate support member 64 is spaced below the vertically-oriented wall portion 66 discussed above to define the narrow slots 29 through which the barrier's side edge portions 25 extend. The intermediate support portion 64 is also positioned to engage and support portions of the guide rod 30 within the respective side guide 28A, 28B. The C-shaped body segments 60, the intermediate support members 64, and the wall portions 66 can be assembled together to form the side guides 28A, 28B with desired dimensions and provide modularity that allows the assembly 10 to be built and assembled at an installation site. This modularity also allows improves access into the side guides 28A, 28B for ease of installation or maintenance of the assembly and over time.

In certain embodiments, this modular configuration of the side guides 28A, 28B results in seams 68 at the interconnection between the adjacent segments. Accordingly, as the barrier 12 moves between the stowed and deployed positions, the carriage 38 will pass over the seams 68. The side guides 28A, 28B of the illustrated embodiment include lifter plates 70 attached to the intermediate support members 64 adjacent to the elongated slot 29. As seen in FIGS. 5A and 5B, the lifter plates 70. Each have an arcuate, convex upper surface 71 configured to engage the rigid plate 52 and/or retention strap 34 connected to the carriage 38. The lifter plate 70 is attached to the support member 64 adjacent to the seams 68 between the interconnected segments such that the forward and rear end portions of the convex upper surface 71 are substantially at or below the lower edge of the elongate slot 29 in the side guides 28A, 28B. The apex of the convex upper surface 71, however, is positioned above the lower edge of the slot 29.

As the barrier 12 moves between the deployed and stowed positions, the carriage 38, the bushing 50, the retention strap 34, and the rigid plate 52 move past the seams 68. As the carriage 38 approaches a seam 68, the rigid plate 52 and/or retention strap 34 engages and slides over the lifter plate's convex upper surface 71, such that the lifter plate 70 causes the carriage 38 to lift upwardly and slightly out of contact with the side guide's lower wall 58 as the plate 52 and/or strap 34 move up and over the apex of the lifter plate's convex upper surface 71. Each lifter plate 71 is positioned relative to the seams so that the wheels 54 on the carriage 38 lift off of the lower wall 58 and pass over the seam 68, so the carriage does not have to physically engage the seam 68 during movement of the barrier 12. As the plate 52/strap 34 move past the apex and downward along the lifter plate's convex upper surface 71 toward the end of the lifter plate 70, the carriage 38 is smoothly set back onto the side guide's lower wall 58 until the next seam. Accordingly, the lifter plates 70 allow the carriages 38 to smoothly move past the seams 68 between segments, even if the adjacent segments are not perfectly aligned and have a slight step up or down across the seams 68 between the segments. In one embodiment, lifter plates 70 can be installed on each side of a seam 68 so that the carriage 38 will be lifted up and over the seam 68 as the barrier moves in either direction to or from the deployed and stowed positions.

As indicated above, the carriage 38, the retention strap 34 and the rigid plate 52 are securely fixed to the bushing 50 and the leading portion of the barrier's sleeve portion 27. Accordingly, when the lifter plates 70 lift the carriages 38 away from the side guide's lower wall 58, the bushing 50 riding on the guide rod 30 is also simultaneously lifted. In the illustrated embodiment, the inside diameter of the bushing 50 is only slightly larger than the outside diameter of the guide rod 30 so the bushing 50 will slide smoothly over the guide rod 30. In the illustrated embodiment, the guide rod 30 can accommodate vertical movement of the bushing because only one end of each guide rod 30 is anchored fixed in place relative to the respective side guide 28A, 28B. The other end of the guide rod 30 is free floating within the side guide to allow some vertical movement of the guide rod 30 within the side guide. Each guide rod 30 of the illustrated embodiments is fixed adjacent to the foot box 20B, and the end of the guide rod 30 adjacent to the head box 20A is free floating and can move vertically within the respective side guide 28A, 28B. Accordingly, when the lifter plate 70 causes the carriage 38 and bushing 50 to lift away from the side guide's lower wall 58, the bushing 50 also lifts its guide rod 30 relative to the side guide's lower wall 58 as the carriage 38 moves past the seam 68.

As the barrier 12 moves between the stowed and deployed positions, the barrier's side edge portions 25 slide over the guide rods 30. In the illustrated embodiment, the side guides 28A, 28B also include a plurality of horizontally-oriented rollers 72 mounted on the side guide's lower wall 58 and positioned to support the guide rod 30 thereon. As the barrier's sleeve portion 27 is pulled along the guide rods 30, the barrier's sleeve portion 27 also moves smoothly over the rollers 72, thereby causing the rollers 72 to rotate about their axes. This engagement between the barrier's sleeve portion 27 and the rollers 72 allows for smooth travel of the side edge portions 25 through the side guides 28A, 28B, while minimizing friction and wear of the barrier's sleeve portion 27 during movement between the deployed and stowed positions. In the illustrated embodiment, the rollers 72 are positioned adjacent to the lifter plates 70 such that, as the carriage 38 and bushing 50 are lifted relative to the side guide's lower wall 58, the bushing 50 is also lifted up and over the roller 72 so as to avoid interference between the bushing 50 and the roller 72 during movement of the barrier 12.

In certain embodiments, the side guides 28A, 28B include reinforcing support brackets 76 positioned between side guide's lower wall 58 and the intermediate support members 64. The support brackets 76 are spaced apart along the respective side guide 28A, 28B to structurally support the span of the intermediate support members 64. The support brackets can also be fastened to wall or other building support structure to which the assembly 10 is mounted. The side guides 28A, 28B can also include one or more heavy duty reinforcement plates 74 anchored directly to the building structures and configured to support most of the load from the weight of the assembly 10 when installed in the building. In the illustrated embodiment, the assembly 10 has a plurality of spaced apart reinforcement plates 74 along the length of the side guides 28A, 28B. Similar reinforcement plates can also be connected to the head and/or foot boxes 20A, 20B. The reinforcement plates 74 of the illustrated embodiment are heavy duty, steel L-shaped members with a vertical leg that fixedly mounts to the building structure and a horizontal leg that supports the side guide 28A, 28B and/or the head or foot boxes 20A, 20B. Because the reinforcement plates 74 carry a substantial amount of the load of the assembly 10 when mounted, the other components of the assembly 10, such as the side guides 28A, 28B and the head and foot boxes 20A, 20B can be made of lighter gauge or lighter weight material. In addition, the reinforcement plates 74 directly mounted to the building structure also allows the assembly 10 to maintains its structural integrity during an emergency event, such as a high temperature fire, thereby allowing the barrier 12 to remain in the deployed position for a substantial period of time during the fire emergency without losing its integrity and effectiveness in closing off the vertical passageway and blocking passage of smoke and vapors through the vertical passageway.

Figure 6:
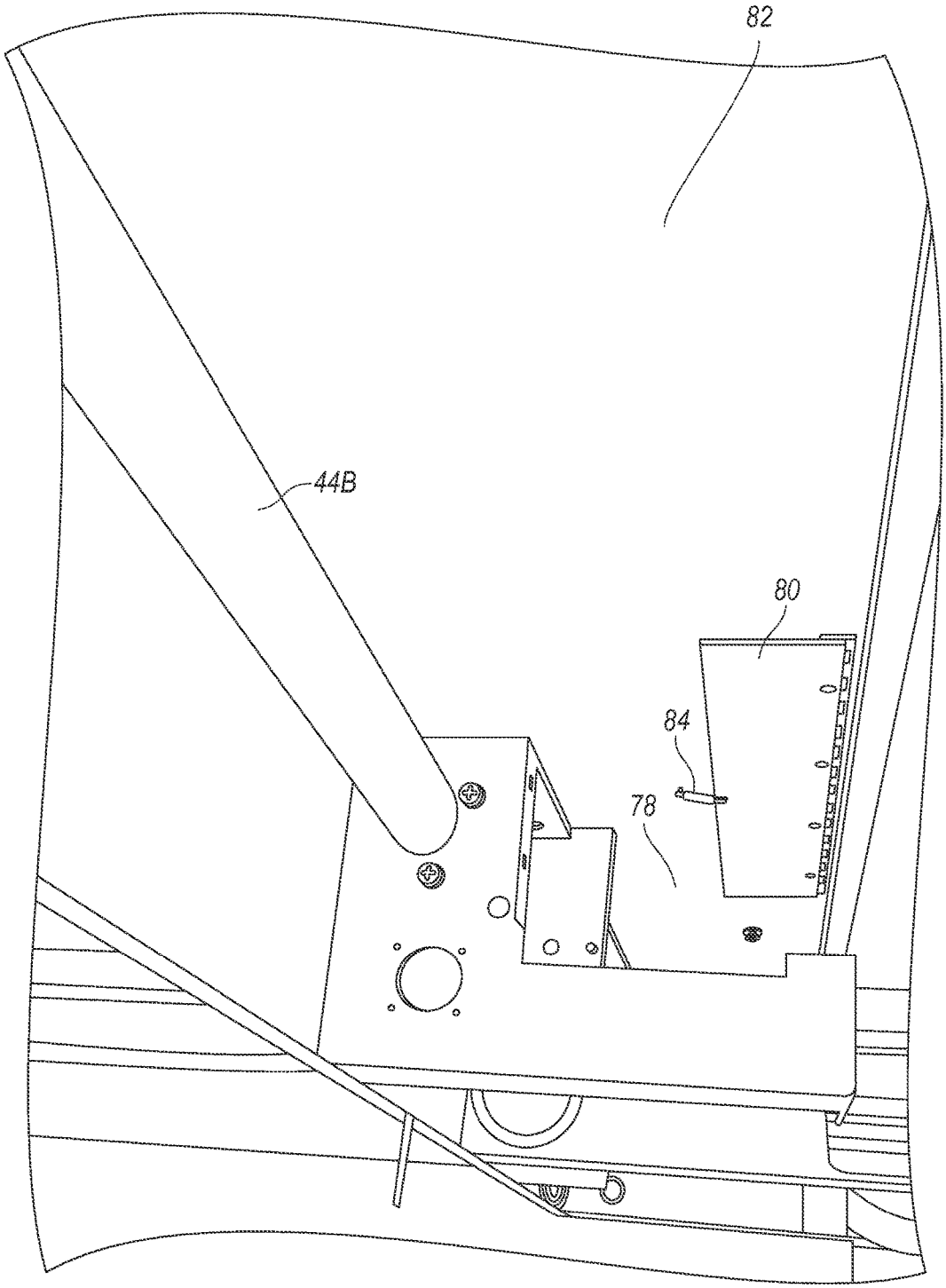
FIG. 6 is a partial view of a segment of the barrier assembly of FIG. 1 with the barrier and other portions of the assembly not shown to illustrate certain features.

When the assembly 10 is activated and the barrier 12 is moved to the fully deployed position, as shown in FIG. 2, the leading edge member 18 is at least partially received by the foot box 20B and retained in the fully deployed position. In the illustrated embodiment shown in FIG. 6, the foot box 20B has a recess area 78 formed therein that receives and supports the leading edge member 18. The foot box 20B of the illustrated embodiment also includes a plurality of closure panels 80 pivotally coupled to an interior side of an upper surface 82 of the foot box 20B. The closure panels 80 are moveable between a stowed horizontal position, as shown in FIG. 6, and a released vertical position. The closure panels 80 are retained in the stowed, horizontal position by activatable release members 84 that will release the closure panels and allow the panels to pivot to the released vertical position, such as during an emergency condition, to effectively capture and retain the leading edge member 18 in the foot box 20B.

In the illustrated embodiment, the release members 84 are thermally activated clips configured to effectively melt or deform at high temperature, such as over 165° C. Once the thermally activated clip 84 melts, the closure panel 80 is released and pivots under the force of gravity the released vertical position generally perpendicular to the upper surface 82. Although the release members 84 of the illustrated embodiment are thermally activated clips, other embodiments can use other release members hold or release the closure panels 80 relative to the foot box 20B and the leading edge member 18 when the barrier is in the fully deployed position.

From the foregoing, it will be appreciated that specific embodiments of the invention have been described herein for purposes of illustration, but that various modifications may be made without deviating from the invention. Additionally, aspects of the invention described in the context of particular embodiments or examples may be combined or eliminated in other embodiments. Although advantages associated with certain embodiments of the invention have been described in the context of those embodiments, other embodiments may also exhibit such advantages. Additionally, not all embodiments need necessarily exhibit such advantages to fall within the scope of the invention. Accordingly, the invention is not limited except as by the appended claims.

We claim:

1. A horizontally deployable vapor barrier assembly for use with a structure having a vertically oriented passageway, comprising:

A frame mountable to the structure around the passageway, the frame having a header, a footer substantially opposite the header, and opposing side guides extending between the header and footer, wherein the side guides comprise a plurality of interconnected side guide segments extending between the header and footer, and adjacent side guide segments have substantially coplanar support surfaces that define a joint therebetween;

A guide rod contained in each side guide, the guide rod extending substantially between the header and the footer;

A vapor barrier coupled to the frame and moveable relative to the passageway between a stowed position wherein the vapor barrier substantially does not obstruct the passageway and a deployed position wherein the vapor barrier extends substantially horizontally across the passageway to block passage of fire or vapor through the passageway, the vapor barrier having opposing side edge portions extending between leading and trailing edge portions, each side edge portion having a sleeve portion surrounding a respective guide rod and being captured in the respective side guide, the sleeve portion being configured to slide axially over the guide rod as the vapor barrier moves between the deployed and stowed positions;

A substantially rigid leading edge member connected to the leading edge portion of the vapor barrier and having lateral end portions adjacent to the side guides, the leading edge member being positioned at least adjacent to the header when the vapor barrier is in the stowed position, and the leading edge member being positioned at least adjacent to the footer when the vapor barrier is in the deployed position;

Support carriages coupled to the leading edge member, each support carriage positioned adjacent to a respective lateral end portion and having a support member positioned to engage and move along the support surfaces of the interconnected segments of the side guide as the vapor barrier moves between the stowed and deployed positions;

A plurality of rollers, at least one roller connected to each of the side guides and positioned adjacent to the guide rod, each roller positioned to support a portion of a respective one of the side edge portions of the vapor barrier, wherein the roller rolls on the side edge portion as the sleeve portion slides axially over the guide rod as the vapor barrier moves between the deployed and stowed positions; and A drive system coupled to the vapor barrier, the drive system being activatable to move the vapor barrier between the stowed and deployed positions.

2. The assembly of claim 1 wherein the vapor barrier has an annular bushing attached to and substantially coaxially aligned with each sleeve portion adjacent to the leading edge portion of the vapor barrier, and each bushing is positioned around a respective guide rod and slideable along at least a portion of the length of the guide rod as the vapor barrier moves between the stowed and deployed positions.

3. The assembly of claim 1 wherein each support carriage is a wheeled carriage having at least one wheel positioned to engage and roll along the support surface as the vapor barrier moves between the stowed and deployed positions.

4. The assembly of claim 1, further comprising a plurality of lifter plates, at least one lifter plate being attached to each of the side guides in alignment with the joints between interconnected segments of the side guides, wherein each lifter plate is positioned to engage the support carriages and temporarily lift the support member out of engagement with the support surface over the joints as the vapor barrier moves between the stowed and deployed positions.

5. The assembly of claim 4 wherein the lifter plates have an arcuate convex engagement surface spaced apart from the support surface and configured so the support carriage engages and moves over the arcuate convex engagement surface to lift the support carriage off of the support surface adjacent to the joints.

6. The assembly of claim 1 wherein each side guide has interconnected wall portions that define an interior area extending longitudinally between the header and footer, at least one of the wall portions defines an elongated slot in communication with the interior area of the side guide, and the slot has a width less than a width of the guide rod and associated sleeve portion, and wherein the side edge portions of the vapor barrier extend through the slots and move longitudinally in the slots as the vapor barrier moves between the stowed and deployed positions.

7. The assembly of claim 1 wherein the header is a modular header comprising a plurality of interconnect axially aligned header modules, and the footer is a modular footer comprising a plurality of interconnect axially aligned footer modules.

8. The assembly of claim 1 wherein the footer is a foot box that captures the leading edge member when the vapor barrier is in the deployed position.

9. The assembly of claim 1, further comprising an accumulator shaft connected to the trailing edge portion of the vapor barrier and coupled to the drive system, and wherein the header is a head box that contains at least a portion of the accumulator shaft, the vapor barrier is wound onto the accumulator shaft and the leading edge member is in or adjacent to the head box when the vapor barrier is in the stowed position.

10. The assembly of claim 1, further comprising:

A plurality of deployment members each having opposing first and second ends, the first ends being attached to the leading edge member;

An accumulator shaft rotatably coupled to the header and connected to the trailing edge portion of the vapor barrier; wherein the vapor barrier is wound around the accumulator shaft when the vapor barrier is in the stowed position;

A drive shaft rotatably coupled to the footer, the drive shaft having a plurality of accumulator spools, each accumulator spool being attached to the second end of a respective one of the plurality of deployment members;

Wherein the drive system comprises first and second drive motors:

the first drive motor being connected to the accumulator shaft and configured to actively rotate the accumulator shaft in a first rotational direction to wind the vapor barrier onto the accumulator shaft and move the vapor barrier toward the stowed position, and the first drive motor is configured to allow the accumulator shaft to rotate in a second rotational direction opposite the first rotational direction as the vapor barrier moves toward the deployed position while keeping the vapor barrier under tension; and the second drive motor is connected to the drive shaft and configured to rotate the drive shaft in a third rotational direction relative to the footer whereby the deployment members are wound onto the accumulator spools to move the vapor barrier toward the deployed position, wherein the second drive motor is configured to provide resistance to the drive shaft and accumulator spools from rotating in a fourth rotational direction opposite the third rotational direction as the first drive motor is actively rotating the accumulator shaft in the first rotational direction to wind the vapor barrier onto the accumulator shaft to maintain tension in the vapor barrier.

11. The assembly of claim 10, further comprising a control system operatively coupled to the first and second drive motors and configured to activate the first and/or second drive motors for movement of the vapor barrier between the stowed position and the deployed position.

12. The assembly of claim 1, wherein each guide rod has a first end portion retained in a fixed position adjacent to the header, and each guide rod has a free second end portion in an unfixed position and movable at least partially vertically within the side guide as the support carriages move over the lifter plates.

13. A vapor barrier assembly for use to removably block a passageway from passage of fire and/or vapors, comprising:

A frame having a header, a footer, and opposing side guides extending between the header and footer, wherein each side guide has an interior area and has a support surface with a surface discontinuity;

An elongate guide member contained in the interior area of each side guide and extending substantially between the header and the footer;

A barrier coupled to the frame and moveable between stowed and deployed positions, in the stowed position the full barrier is substantially adjacent to the header, and in the deployed position the barrier extends substantially fully between the header and footer and between the side guides, the barrier having opposing leading and trailing edge portions and opposing side edge portions extending between the leading and trailing edge portions, at least a portion of each side edge portion being captured within the interior area of a respective side guide and slidably engaging a respective guide member, the side edge portion being configured to slide axially over the guide member as the barrier moves between the deployed and stowed positions;

A leading edge member connected to and movable with the leading edge portion of the barrier relative to the frame, the leading edge member extending between the side guides and having an end portion adjacent to at least one of the side guides;

A support carriage movable with the leading edge member as a unit relative to the side guides, the support carriage positioned adjacent to a respective end portion and having a support member positioned to move along the support surface of the respective side guide as the barrier moves between the stowed and deployed positions; and A lifter plate attached to the side guides adjacent to the surface discontinuity, the lifter plate having an engagement surface positioned to engage the support carriage and temporarily lift the support member out of engagement with the support surface over the surface discontinuity as the barrier moves between the stowed and deployed positions.

14. The assembly of claim 13, further comprising a plurality of rollers, at least one roller connected to each of the side guides and positioned adjacent to the guide member, each roller positioned to support a portion of a respective one of the side edge portions of the vapor barrier, wherein the roller rolls on the edge portion as the sleeve portion slides axially over the guide member as the vapor barrier moves between the deployed and stowed positions.

15. The assembly of claim 13 wherein the support carriage is a wheeled carriage having at least one wheel positioned to engage and roll along the support surface as the barrier moves between the stowed and deployed positions.

16. The assembly of claim 13 wherein the guide member is a guide rod, and at least one of the side edge portions of the barrier has a sleeve portion that extends over and slides along the guide rod when the barrier moves between the stowed and deployed positions.

17. The assembly of claim 13 wherein the guide member is a guide rod with a first end portion retained in a fixed position adjacent to the header, and the guide rod has a free second end portion opposite the first end portion in an unfixed position and movable at least partially vertically within the side guide as the support carriage moves over the lifter plates.

18. The assembly of claim 13 wherein the side guide comprises a plurality of interconnected guide segments, and the surface discontinuity is formed by a joint between adjacent guide segments.

19. The assembly of claim 13 wherein each side guide has interconnected wall portions that define an interior area extending longitudinally between the header and footer, at least one of the wall portions defines an elongated slot in communication with the interior area of the side guide, and the slot has a width less than a width of the guide member and associated side edge portion of the barrier, and wherein the side edge portion of the barrier extends through the slot and moves longitudinally in the slots as the vapor barrier moves between the stowed and deployed positions.

20. The assembly of claim 13 wherein the header is a modular header comprising a plurality of interconnect axially aligned header modules, the footer is a modular footer comprising a plurality of interconnect axially aligned footer modules, the side guides are modular side guides comprising a plurality of interconnected axially aligned side guide segments, wherein the surface discontinuity is defined by at least one joint between adjacent side guide segments.

21. The assembly of claim 13, further comprising:

A plurality of deployment members each having opposing first and second ends, the first ends being attached to the leading edge member;

An accumulator shaft rotatably coupled to the header and connected to the trailing end of the barrier; wherein the barrier is wound around the accumulator shaft when the barrier is in the stowed position;

A drive shaft rotatably coupled to the footer, the drive shaft having a plurality of accumulator spools, each accumulator spool being attached to the second end of a respective one of the plurality of deployment members; and A drive system comprising first and second drive motors:

the first drive motor being connected to the accumulator shaft and configured to actively rotate the accumulator in a first rotational direction to wind the barrier onto the accumulator shaft and move the barrier toward the stowed position, and the first drive motor is configured to allow the accumulator shaft to rotate in a second rotational direction opposite the first rotational direction as the barrier moves toward the deployed position while keeping the barrier under tension; and the second drive motor is connected to the drive shaft and configured to rotate the drive shaft in a third rotational direction relative to the footer whereby the deployment members are wound onto the accumulator spools to move the barrier toward the deployed position, wherein the second drive motor is configured to provide resistance to rotation of the drive shaft in a fourth rotational direction opposite the third rotational direction as the first drive motor is actively rotating the accumulator shaft in the first rotational direction to wind the barrier onto the accumulator shaft to maintain tension in the barrier.

22. A horizontally deployable vapor barrier assembly for use to removably block a vertically oriented passageway in a building structure, comprising:

A modular frame mountable to the structure around the passageway, the frame having a headbox comprising a plurality of interconnected headbox segments, a footbox substantially opposite the headbox and comprising a plurality of interconnected footbox segments, and opposing side guides extending between the header and footer, wherein the side guides comprise a plurality of interconnected side guide segments extending between the headbox and footbox, wherein each side guide has interconnected wall portions that define an interior area extending longitudinally between the header and footer, at least one of the wall portions defines an elongated slot in communication with the interior area of the side guide, and wherein adjacent side guide segments have substantially coplanar support surfaces that define a joint therebetween;

A pair of guide rods contained in the interior areas of the side guides, each guide rod extending substantially between the headbox and the footbox, wherein each guide rod has a first end portion retained in a fixed position adjacent to the headbox, and a free second end portion in an unfixed position and movable at least partially vertically within the interior area of the side guide, each guide rod having a thickness greater than the width of the slot in the respective side guide such that the guide rod cannot pass laterally through the slot of the side guide;

A horizontally oriented vapor barrier coupled to the frame and moveable relative to the passageway between a stowed position wherein the vapor barrier substantially does not obstruct the passageway and a deployed position wherein the barrier extends substantially horizontally across the passageway between the headbox and the footbox and between the opposing side guides to block passage of fire or vapor through the passageway, the vapor barrier having opposing side edge portions extending between leading and trailing edge portions, each side edge portion extending through the slot in the side guide and having a sleeve portion surrounding at least a portion of the guide rod in the side guide so the side edge portion is captured in the respective side guide and prevented from moving laterally through the slot away from the side guide, a leading edge of the sleeve portion being connected to an annular bushing substantially coaxially aligned with the sleeve portion, and the annular bushing being positioned around the respective guide rod in the side guide, wherein the sleeve portion and the annular bushing are slidable along at least a portion of the length of the guide rod as the vapor barrier moves between the stowed and deployed positions;

A substantially rigid leading edge member connected to the leading edge portion of the vapor barrier and having lateral end portions adjacent to the side guides, the leading edge member being positioned at least adjacent to the headbox when the vapor barrier is in the stowed position, and the leading edge member releasably captured in the footbox when the vapor barrier is in the deployed position;

Wheeled support carriages coupled to the leading edge member, each wheeled support carriage positioned adjacent to a respective lateral end portion and having a support wheel positioned to engage and roll along the support surfaces segments of the side guide as the vapor barrier moves between the stowed and deployed positions;

A plurality of lifter plates attached to each of the side guides in alignment with the joints between interconnected segments of the side guides, wherein the lifter plates are positioned to engage the wheeled support carriages and temporarily lift the support member out of engagement with the support surface over the joints as the barrier moves between the stowed and deployed positions, wherein each lifter plate has an arcuate convex engagement surface spaced apart from the support surface and configured so the wheeled support carriage engages and moves over the arcuate convex engagement surface to lift the support wheel off of the support surface adjacent to the joints;

A drive system coupled to the barrier, the drive system being activatable to move the vapor barrier between the stowed and deployed positions;

A plurality of deployment cables each having opposing first and second ends, the first ends being attached to the leading edge member;

An accumulator shaft rotatably coupled to the header and connected to the trailing edge portion of the vapor barrier; wherein the vapor barrier is wound around the accumulator shaft when the vapor barrier is in the stowed position;

A drive shaft rotatably coupled to the footer, the drive shaft having a plurality of accumulator spools, each accumulator spool being attached to the second end of a respective one of the plurality of deployment cables;

A drive system comprising first and second drive motors, wherein:

The first drive motor is connected to the accumulator shaft and configured to actively rotate the accumulator in a first rotational direction to wind the vapor barrier onto the accumulator shaft and move the vapor barrier toward the stowed position, and the first drive motor is configured to allow the accumulator shaft to rotate in a second rotational direction opposite the first rotational direction as the vapor barrier moves toward the deployed position while keeping the vapor barrier under tension; and The second drive motor is connected to the drive shaft and configured to rotate the drive shaft in a third rotational direction relative to the footer whereby the deployment cables are wound onto the accumulator spools to move the vapor barrier toward the deployed position, wherein the second drive motor is configured to provide resistance to the drive shaft and accumulator spools from rotating in a fourth rotational direction opposite the third rotational direction as the first drive motor is actively rotating the accumulator shaft in the first rotational direction to wind the vapor barrier onto the accumulator shaft to maintain tension in the vapor barrier;

A control system operatively coupled to the first and second drive motors and configured to activate the first and/or second drive motors for movement of the vapor barrier between the stowed position and the deployed position; and A biasing member coupled to the drive shaft or the accumulator shaft and configured to apply a rotational biasing force for decreasing rotational slip during movement of the vapor barrier between the stowed and deployed positions.

* * * * *